US006993278B2

(12) United States Patent
Bartscher et al.

(10) Patent No.: US 6,993,278 B2
(45) Date of Patent: Jan. 31, 2006

(54) FIXING DEVICE TRANSPORT FOR A DIGITAL PRINTER OR COPIER MACHINE

(75) Inventors: Gerhard Bartscher, Köln (DE); Frank-Michael Morgenweck, Molfsee (DE); Kai-Uwe Preissig, Dortmund (DE); Domingo Rohde, Kiel (DE); Detlef Schulze-Hagenest, Molfsee (DE); Ralf Gerald Allner, Esslingen (DE); Thomas Biber, Aalen (DE); Markus Weber, Aichwald (DE)

(73) Assignee: Eastman Kodak Company, Rochester, NY (US)

( * ) Notice: Subject to any disclaimer, the term of this patent is extended or adjusted under 35 U.S.C. 154(b) by 786 days.

(21) Appl. No.: 10/023,957

(22) Filed: Dec. 18, 2001

(65) Prior Publication Data

US 2002/0139264 A1 Oct. 3, 2002

(30) Foreign Application Priority Data

Dec. 22, 2000 (DE) ..... 100 64 556
Mar. 21, 2001 (DE) ..... 101 13 885

(51) Int. Cl.
*G03G 15/20* (2006.01)

(52) U.S. Cl. ..... 399/322; 219/216; 399/336

(58) Field of Classification Search ..... 399/322, 399/329, 336, 335, 320, 341; 219/216, 388, 219/678; 430/124; 347/156; 101/232
See application file for complete search history.

(56) References Cited

U.S. PATENT DOCUMENTS

| | | | | |
|---|---|---|---|---|
| 3,942,266 A | | 3/1976 | Honjo et al. | 34/122 |
| 4,294,539 A | | 10/1981 | Spehrley, Jr. | 355/76 |
| 4,768,057 A | * | 8/1988 | Kumada et al. | 399/336 |
| 5,081,502 A | * | 1/1992 | Mitsuya et al. | 399/336 |
| 5,608,511 A | | 3/1997 | Attridge | 399/398 |
| 5,669,032 A | * | 9/1997 | Islam et al. | 219/216 X |
| 5,784,679 A | * | 7/1998 | Schlueter et al. | 399/335 |
| 6,130,408 A | * | 10/2000 | Fukuda et al. | 219/216 |

FOREIGN PATENT DOCUMENTS

DE 27 06 867 9/1977

(Continued)

OTHER PUBLICATIONS

International Search Report, 101 13 885.7, dated Aug. 5, 2002.

*Primary Examiner*—Sophia S. Chen
(74) *Attorney, Agent, or Firm*—Lawrence P. Kessler

(57) ABSTRACT

A digital printer or copier machine (1) is proposed for the single-sided or double-sided printing of a substrate (11), with at least one fixing device (3) for fixing toner onto the substrate (11), whereby the fixing device (3) has at least one heating device for fusing the toner. The machine has, in addition, at least one transport device (17), in order to supply the substrate (11) to the heating device, to guide it past the heating device and/or to further transport it from the heating device, whereby the transport device (17) has at least one suction belt (19) that is provided with a number of through-passage openings (21) and can be impinged with a vacuum. The machine (1) is characterized in that the suction belt (19) is constructed as a mesh.

18 Claims, 3 Drawing Sheets

FOREIGN PATENT DOCUMENTS

| | | | | |
|---|---|---|---|---|
| EP | 0 223 502 | | | 5/1987 |
| GB | 1513 846 | | | 1/1978 |
| JP | 57104152 | A | | 6/1982 |
| JP | 57-130074 | A | * | 8/1982 |
| JP | 61084663 | A | | 4/1986 |
| JP | 01-185680 | A | * | 7/1989 |
| JP | 01-270086 | A | * | 10/1989 |
| JP | 06092503 | | | 4/1994 |
| JP | 09142687 | A | | 6/1997 |
| WO | 94 09 408 | A1 | | 7/1993 |

* cited by examiner

FIXING DEVICE TRANSPORT FOR A DIGITAL PRINTER OR COPIER MACHINE

FIELD OF THE INVENTION

The invention involves a digital printer or copier machine for the single-sided or double-sided printing of a substrate, the machine including a substrate transport device having a mesh suction belt.

BACKGROUND OF THE INVENTION

Digital printers or copier machines are known which operate according to the electrophotographic process, in which a latent electrostatic image is developed by charged toner particles. These particles are transferred onto an image receiving substrate, hereinafter referred to simply as "substrate". Afterwards, the developed image that has been transferred onto the substrate is fixed by the toner particles being heated and fused. In order to fuse the toner particles, contacting processes are often used in which the toner particles are brought into contact with suitable devices, for example, hot rollers or cylinders. It is disadvantageous that it is usually necessary to use silicone oil as a separating agent that should prevent an adhesion of the fused toner onto the heating device. In addition, the design, the maintenance and the operating costs of these heating devices that operate by contact are expensive and thus cost-intensive. Furthermore, the defect rate caused by the contacting heating devices is relatively high. Nevertheless, process methods of this type continue to be popular and make possible a fixing of the toner that acts by pressure impingement into the structure of the substrate.

In order to fix the toner that has been transferred onto the paper, for example, heating devices and processes are also known that operate in a contactless manner, in which for example, the toner particles are fused using heat radiation and/or microwave radiation or with hot air.

In the contacting and non-contacting fusing processes, toner is used, for example, that has a glass transformation temperature (TG) in a range from 45° C. to 75° C. The glass transformation temperature, at which the toner—starting from the solid state—begins to soften, can be influenced by the choice of raw materials and by the addition of certain additives to the toner. In a fixing device for the toner, which has at least one heating device, both the toner and the substrate itself are heated up. In order to be able to ensure a good fixing of the toner onto the substrate, the surface temperature of the substrate must be in the range of the glass transformation temperature of the toner or above it. The toner easily reaches and/or exceeds the glass transformation temperature ($T_G$) in the area of the heating device.

Printers and copier machines are known in which the substrate is printed double-sided, whereby for the printing of the front side and the rear side, either one and the same image creation and transfer device and heating device, or a separate image creation and transfer device and a separate heating device are each used. In order to fix the toner image, the substrate is often guided past the at least one image creation and transfer device and the allocated heating device using a conveyor belt on which the substrate lies. In the process, at first a first toner image is transferred onto a first side of the substrate and fixed onto it. Then, a second toner image is transferred and fixed onto the second side of the substrate. During the fusing of the second toner image, the first side of the substrate with the first toner image that is located on it and has already been fixed onto it, thus rests on the conveyor belt. It is disadvantageous in this process that during the fusing of the second toner image, the first toner image can heat up so much that is becomes soft and tends to adhere to the conveyor belt. This can lead to several undesired effects: Due to the adhesion, the substrate can become jammed when the substrate is passed from the conveyor belt to a subsequent part of the machine. Furthermore, the appearance of the toner image can change in the areas in which it is adhered to the conveyor belt. This leads to problems with the image quality; for example, the toner image has a non-uniform gloss. These undesired effects are amplified by pressure impingement with a hot roller when the toner is fixed by contact.

Conveyor belts are known which are constructed as a suction belt, i.e. they have a number of openings through them that are impinged by a vacuum and on which the substrate can be suctioned and in this way held. The known suction belt has the same disadvantages as a conveyor belt with a solid supporting surface.

SUMMARY OF THE INVENTION

The purpose of the invention is to provide a digital printer or copier machine, in which a suction belt is provided for the transport of a substrate carrying a toner, before, through and/or after the heating device, and in which the appearance and processing of the toner image is not or at least only negligibly changed or damaged by the suction belt, and in particular, a double-sided printing of a substrate is possible at simultaneously high quality of the toner images applied onto the front and rear side of the substrate.

In order to achieve the purpose of the invention, a digital printer or copier machine is proposed that contains at least one fixing device that functions to fix a toner image transferred onto a substrate. The toner image can have one or more color. In connection with the invention presented, "toner image" is also understood to be a coating that has at least one toner layer. The substrate can, for example, be a sheet or a continuous web, which is made, for example, out of paper or cardboard. In order to fix the toner, which is preferably dry, onto the substrate, it is conducted past a heating device that is part of the fixing device. In order to feed the substrate to the heating device, to guide it past the heating device and/or to further transport it from the heating device to a subsequent part of the machine, at least one transport device is provided, which has at least one suction belt that has a number of openings that can be impinged by a vacuum. The printer and/or copier machine according to the invention is characterized in that the suction belt is constructed as a mesh, preferably in the manner of a close-meshed sieve or net. If the substrate is printed on both sides and a first toner image has already been fixed on the first side of the substrate, the substrate lies with its underside, on which the first toner image has already been fixed, on the sieve or net, while a second toner image is fused onto the upper side of the substrate. The first toner image can thus possibly heat up so much during the fusing of the second toner image that it might become soft and/or pasteous, but not liquid. Because of the vacuum impingement of the sieve or net, the substrate is pulled onto the sieve or net so that the surface structure of the sieve or net almost penetrates into the soft first toner image. By the openings and the stays between the openings being so small according to the invention and/or only having such a small width, the change to the surface structure of the first toner image as a result of the penetration of the sieve structure is only so small that it can not, or at the least, can hardly be recognized by an observer with the naked eye. Through the suction belt according to the invention, the image quality, especially the gloss of the first toner image that gets into contact with the suction belt during the fixing of the second toner image, is not changed and/or only changed to a very small extent in the visible range. In addition, using the suction belt, a secure, crease-free guidance of the substrate, especially even at high transport speeds, can be ensured, especially also if the transport distance is divided up, before, through and after the heating device, into several independently drivable transport sections, in which each subsequent transport section is driven somewhat faster than the preceding transport section and runs at a somewhat higher speed than other instruments that drive the substrate, e.g. a contacting heating roller. A resulting relative speed of the substrate, which has been reduced compared to the suction belt, is safe as a result of the structure according to the invention, especially if, as provided according to an additional embodiment of the invention, the suction belt is constructed as a wide, endless and seamless fabric belt that ensures, as a particular advantage, a homogenous temperature distribution in the area of the entire substrate and a uniform structure of the suction belt in this area.

In a preferred embodiment form, it is provided that the total cross-section flow-through area of the openings is larger, preferably markedly larger than the total area of the stays (i.e., fabric material runs) between the openings. In this way it is ensured that the greater portion of the area of the second toner image has no contact with the suction belt and thus is completely unaffected by it. Advantageously, the openings of the sieve or net have a diameter that is less than 1.0 mm. The smallest diameter of the openings can be several micrometers.

In order to prevent the first toner image located on the underside of the substrate from adhering to the suction belt, at least the surface of the suction belt coming into contact with the substrate can be coated with a separating agent. The soft first toner image does not adhere to the separating agent, so that the substrate can be safely separated from the suction belt. As a separating agent, a Teflon coating can be used, for example. As an alternative, it can be provided that the entire sieve or net is made out of the separating agent. In addition to or as an alternative, the suction belt can be coated with a thin layer of a "release agent", for example, silicone oil.

According to an additional embodiment of the invention, it is provided that at least the surface of the suction belt coming into contact with the substrate is coated with a material that has a low surface energy. In this way, the adhesive forces of the first toner image, made soft by the fusing of the second toner image, onto the suction belt are only low so that here as well a secure separation between the suction belt and the substrate is possible. A substrate jam or problems during the transfer of the substrate from the suction belt to a subsequent part of the machine, for example, to a delivery area, can thus be substantially eliminated. As an alternative, of course, the entire suction belt can also be made out of the material that has a low surface energy.

Furthermore, an embodiment example of the machine is preferred in which at least one cooling device is provided for the cooling of the suction belt. Using the cooling device, the suction belt is cooled off so much that the first toner image that comes into contact with the suction belt and is located on the underside of the substrate is not fused again during the fusing of the second toner image located on the upper side of the substrate. Preferably, so much heat is drawn off of the first toner image via the cooled suction belt that the toner layer of the first toner image does not become soft. In this way, the image quality of the first toner image remains completely unaffected by the fixing operation of the second toner image.

In a preferred embodiment form, the cooling device is arranged on the side of the suction belt that lies opposite the substrate and to be precise,—as seen in the substrate transport direction—in front of the fixing device or within the fixing device. The cooling device can thus, for example, be arranged opposite the heating device, so that the suction belt is cooled immediately at the position in the fixing device at which the second toner image is fused.

According to an additional embodiment of the invention, it is provided that the flat side of the suction belt, which comes into contact with the substrate, has a defined surface roughness that is selected depending on the desired gloss of the fixed toner. The surface structure of the suction belt, which, when the toner image lying on it is overheated, penetrates into the toner image, determines the gloss of the toner image. The smoother the surface of the suction belt, the smoother the surface of the toner image sucked onto the suction belt is as well, and the higher is its gloss. In this embodiment form, the penetration of the surface structure of the suction belt into the already fixed toner image is thus desired directly, so that a gloss can be set that is defined, uniform and above all, can be reproduced in a simple way. In this way, the control of the fusing operation can be simplified at least for the first toner image. Preferably, in this embodiment example, the suction belt can be made of an electrostatic suction belt. Conversely, however, if desired, the suction belt can be equipped instead with an antistatic element, in order to prevent an adherence of the substrate and to promote delivery and transfer.

The suction belt according to the invention can, for example, be made out of a coated metal, coated polyamide, or Teflon. The suction belt coating or the material out of which the suction belt is made is preferably resistant to wear and has only a low surface energy. Preferably, a thin layer of a "release agent" such as silicone oil is applied onto the suction belt.

In order to set a defined surface roughness of the suction belt, it is sandblasted or peened, for example. The diameter of the processing material that is thrown onto the suction belt, for example, diameter of the sand in the case of sandblasting, determines the roughness of the suction belt.

An embodiment example of the machine can provide that the heating device has at least one microwave resonator through which the suction belt is guided. The microwave resonator impinges the substrate that lies flat on the suction belt with microwave radiation, whereby the toner image located on the upper side of the substrate is fused. Using the suction belt, an exact guidance of the substrate along the transport path can be ensured.

It is also to be noted that the front side of the substrate—depending on the view—can form both the upper side and the underside, i.e. the first toner image can be located on the front side or the rear side of the substrate. The same applies for the second toner image.

In particular, according to a further embodiment of the invention, the suction belt can essentially be made of a fabric, whereby "fabric" is to be understood generally and in a wide context and in particular also includes a knit fabric or the like, for example, and not just an actually woven fabric. It is advantageous that the suction belt contains a fabric that extends uniformly over the entire width and in this way forms a uniform support for the entire substrate.

Preferably, the fabric of the suction belt is manufactured as a solid loop so that it is endless and seamless, for example, as a section of a seamlessly manufactured tube or hose. The fabric can preferably be made out of polyester and for example, contain an anti-static element and/or a stiffening element, both of which can be more or less integrated into the fabric in the form of a yarn or fusing thread. In the process, a stiffening element can act in the crosswise and/or longitudinal direction of the suction belt.

An additional embodiment of the invention provides that at least one guide element is arranged on the suction belt, preferably two guide ribs running parallel to each other are arranged along the lower edge sides of the suction belt, which are in mesh with the guide grooves in a drive shaft of the suction belt and prevent a sliding of the suction belt in a crosswise direction, i.e. in the axial direction of the drive shaft. The guide ribs can, for example, be made out of a rubber-like, bendable material, so that they can follow the bends of the suction belt in a belt-like manner.

The invention, and its objects and advantages, will become more apparent in the detailed description of the preferred embodiment presented below.

BRIEF DESCRIPTION OF THE DRAWINGS

Embodiment examples from which additional characteristics of the invention can be ascertained, but to which the invention is not limited in its scope, are shown in the drawings. Shown are.

DETAILED DESCRIPTION OF THE INVENTION

Figure 1:
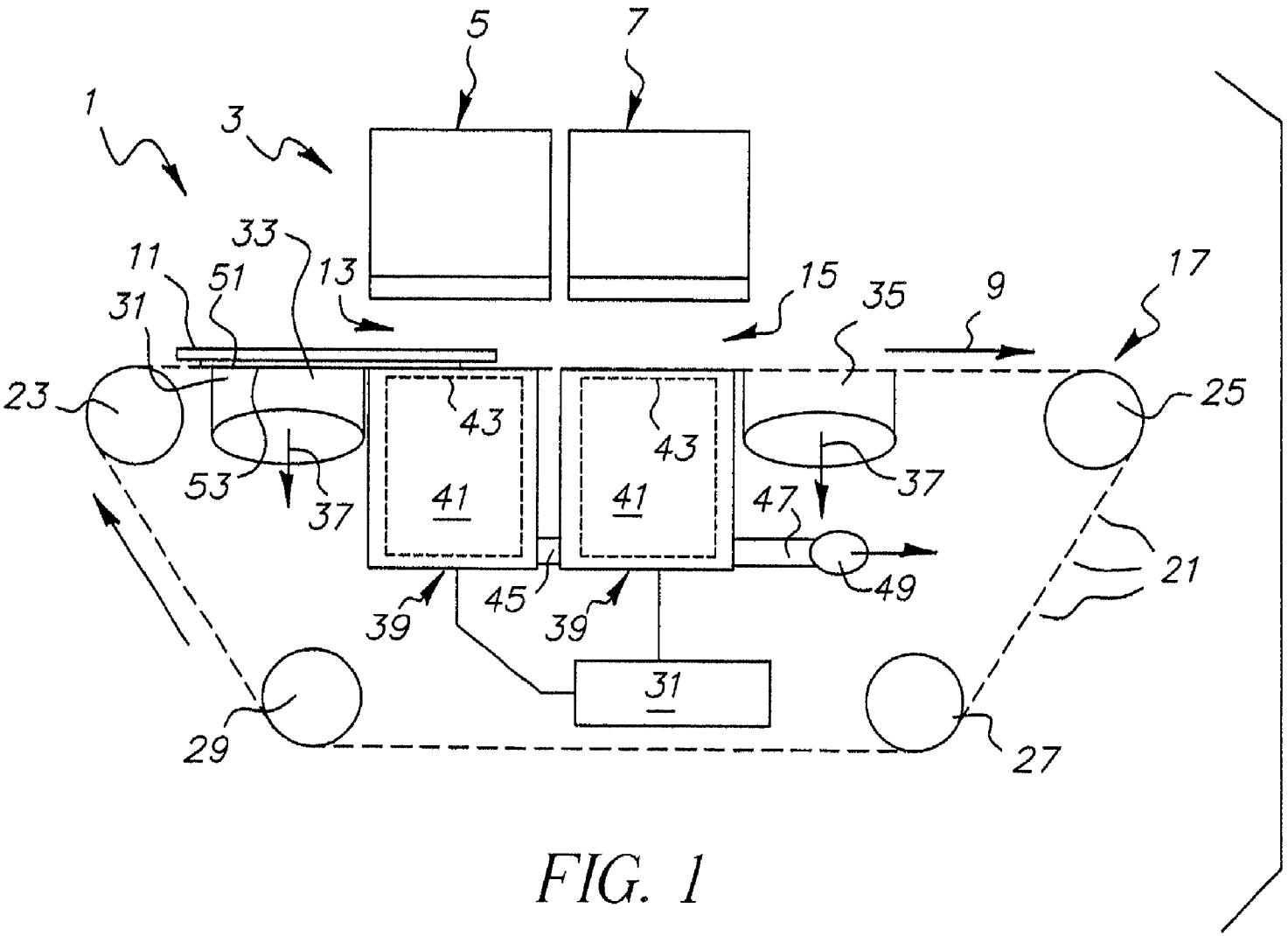
FIG. 1 is a schematic diagram of a section from a first embodiment example of a printer or copier machine according to the invention in a longitudinal section.

The invention is explained in detail using FIG. 1. It shows, in a schematic diagram as a first embodiment example, a section out of a digital printer or copier machine 1, namely a fixing device 3, which functions for fixing a toner on a substrate 11 such as a paper sheet.

The fixing device 3 has a heating device, which here is formed from a first microwave resonator 5 and a second microwave resonator 7. The microwave resonators 5, 7—as seen in the transport direction 9 of the substrate 11—are arranged one after the other a small distance apart. The design and function of the microwave resonators 5, 7 are fundamentally known, so that only a brief description of them follows. The microwave resonators 5, 7 each have a slit-shaped opening 13 and/or 15, through which the transport path of the substrate 11 runs. Within the openings 13, 15, the substrate 11 is impinged with microwave radiation, whereby a toner image that has been transferred onto the upper side of the substrate is fused and bonds with the substrate 11.

In order to guide the substrate 11 along the transport path through the microwave resonators 5, 7, a transport device 17 is provided which has at least one suction belt 19, which is provided with a number of openings 21. The suction belt 19 according to the invention is made from a close-meshed sieve. The suction belt 19 that preferably extends over the entire substrate width is constructed here as an endless belt and is guided over guide rollers 23, 25, 27 and 29. The guide rollers 23, 25 are arranged so that the suction belt section located between them runs along hypothetical horizontal parallel lines to one another. As can be seen from the figure, the suction belt section located between the guide rollers 23 and 25 is guided through the openings 13, 15 of the microwave resonators 5, 7.

Inside of the suction belt loop, a magnetron 31 is arranged, which functions to supply the microwave resonators 5, 7 with microwave radiation. Furthermore, suction boxes 33 and 35 are provided, which are arranged before and/or after the microwave resonators 5, 7—as seen in the substrate transport direction. The suction boxes 33, 35, which can extend over the entire width of the suction belt 19, are connected to a vacuum source (not shown) by which air between the substrate 11 and the suction belt 19 can be extracted via the openings 21 in the suction belt 19, as indicated with the arrows 37. In this way, the substrate 11 is held securely on the suction belt 19.

In the embodiment examples shown in the figure, a suction box 39 is integrated into each of the microwave resonators 5, 7, and it includes a vacuum chamber 41 arranged in the part of the microwave resonator located beneath the transport path of the substrate 11. The vacuum chamber 41 has an opening for the suction of the suction belt section lying between the guide rollers 23, 25. The opening is covered using a perforated plate 43, which, for example, is made out of Teflon. The vacuum chambers 41 are connected to each other via a connection channel 45, and to a fan 49 via a common connection channel 47, for the impingement of the vacuum chambers 41 by a vacuum.

Regarding the function of the fixing device 3: The substrate 11 is guided onto the suction belt 19 by a part of the machine 1 arranged before the fixing device 3 and placed flat on the suction belt section located between the guide rollers 23, 25, as shown in the figure. The toner image to be fixed is located on the upper side of the substrate 51. On the underside of the substrate 53, an additional, first toner image is located, which has already been fixed onto the substrate 11 in a prior fixing operation. By a displacement of the suction belt 19 in the transport direction 9, the substrate 11 is guided one after the other through the slit-shaped openings 13, 15 of the microwave resonators 5, 7 and in the process impinged with microwave radiation, so that the toner image located on the upper side of the substrate 51 is fused and fixed. In the area of the suction boxes 33, 35 and the microwave resonators 5, 7 and/or their vacuum chambers 41, the substrate 11 is sucked onto the suction belt 19. After the substrate 11 has left the active area of the microwave resonators 5, 7, it is separated from the suction belt 19 in the area of the guide roller 25 and guided onto a subsequent part of the machine 1. The suction of the suction belt section located between the guide rollers 23, 25 functions in addition also for the stabilization of the suction belt 19.

The fixing device 3 described in FIG. 1 is characterized by a compact design. In another embodiment example (not shown), it is provided that the heating device contains only one microwave resonator for the fusing of the toner image. As an alternative, a radiation device that impinges the toner image with electromagnetic radiation, in the UV-range and/or infrared range, for example, can also be used as the heating device. As an alternative or in addition, the toner image can also be impinged with hot air or steam in order to fuse it. It is also conceivable that the heating device has, for example, at least one heatable heating roller and/or heating cylinder, which contacts the toner image mechanically in order to fuse it. The explanation of this possibility will be resumed later in connection with the embodiment example according to FIGS. 2 and 3.

In addition, it can be provided that a cooling device (not shown) is allocated to the suction belt 19. The cooling device functions for the cooling of the conveyor belt. The cooling device can, for example, be arranged inside the suction belt loop and cool the suction belt, for example, in its return area between the rollers 25, 27, 29 and 23.

The toner mentioned in connection with the invention presented here can be a liquid or a dry toner.

Figure 2:
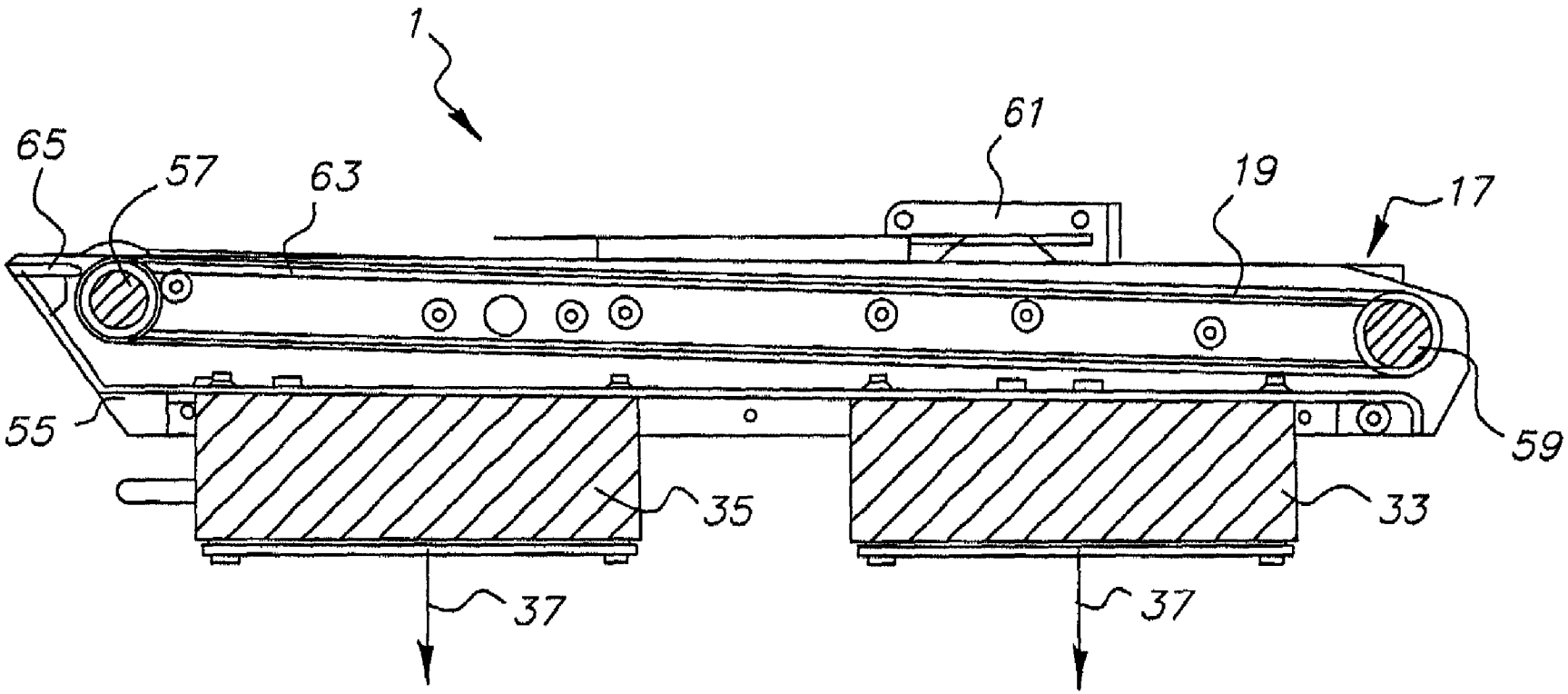
FIG. 2 is a section from a second embodiment example in longitudinal section.
Figure 3:
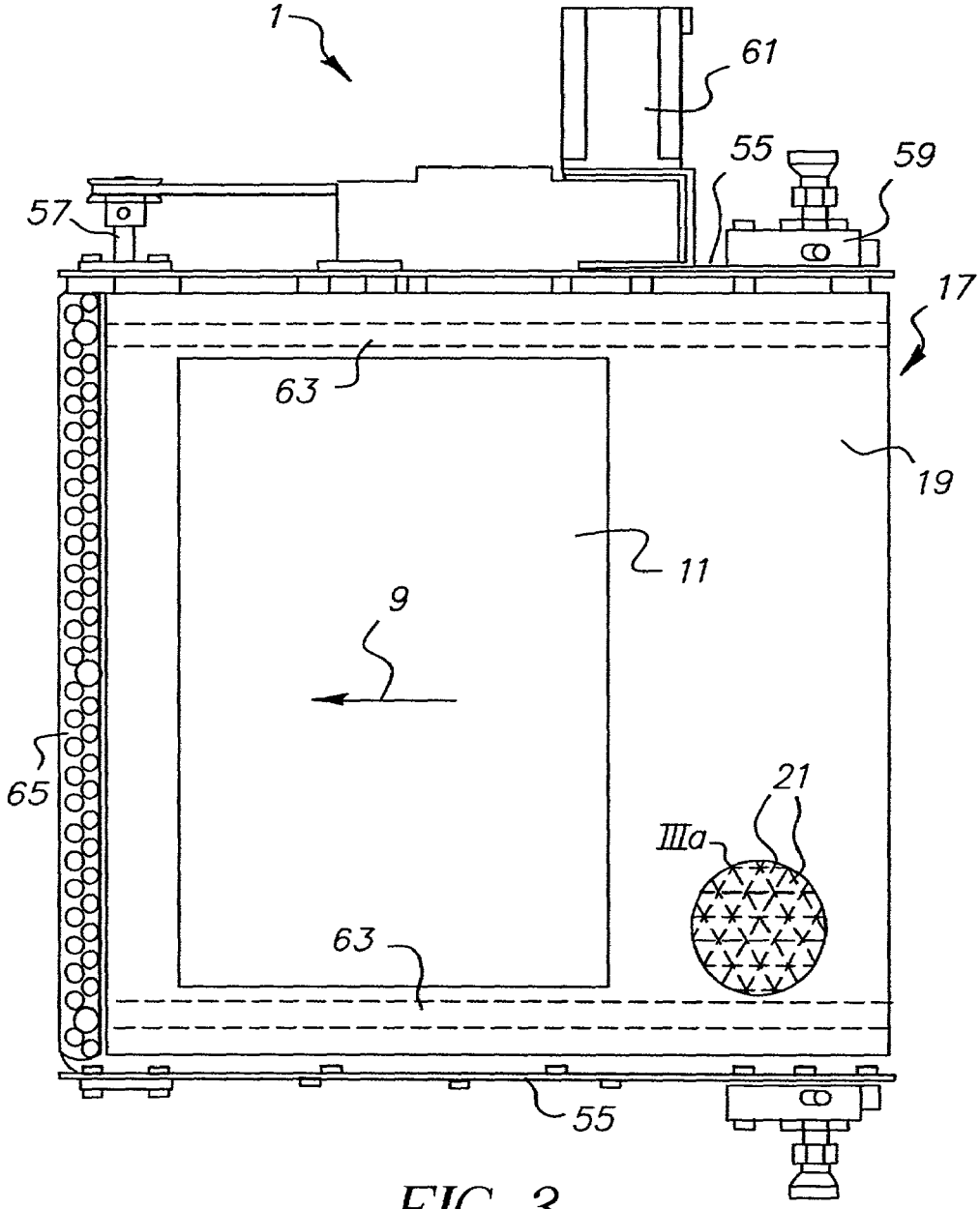
FIG. 3 is the section according to FIG. 2 in overhead view.

In the second embodiment example shown in FIGS. 2 and 3, once in a longitudinal section and once in an overhead view, the at least one suction belt 19 of the transport device 17 consists of a woven, meshed fabric. Equivalent and/or corresponding structural components in FIGS. 2 and 3 are identified with the same reference indicators as in FIG. 1.

The transport device 17 described using the figures can function both for the supply of the substrate to the heating device as well as for guiding the substrate past the heating device and for the continued transport of the substrate to a subsequent part of the printer or copier machine 1. It is clear from all of this that the transport device 17 can function alternatively also only to supply the substrate to the heating device, whereby for this purpose the at least one suction belt of the transport device is returned in front of the heating device to the beginning of the transfer section. According to an additional embodiment variation, it is provided that the transport device guides the substrate past the heating device exclusively, whereby the feed of the substrate and its further transport from the heating device to a subsequent part of the machine is done with the help of at least one additional transport device. According to a third embodiment variation, it is provided that the transport device 17 functions exclusively for the further transport of the substrate from the heating device to a subsequent part of the machine. Of course, the at least one transport device 17 can also be constructed in such a manner that with its help, the substrate 11 is supplied to the heating device, guided past the heating device and/or transported further from the heating device.

The use of the respective suction belt 19 and the possible subdivisions of the transport section indicated above can be also especially dependent on the type of the respective heating device used. For example, it would be possible to use a suction belt 19 according to the embodiment example from FIG. 1 in a microwave heating device, in order to transport the substrate through the heating device, while, for example, a transport section could be taken according to the embodiment example from FIGS. 2 and 3 in order to transport and span the path between the toner color decks and the actual printing decks and the heating device.

On the contrary, only one continuous transport section according to the second embodiment example from FIGS. 2 and 3 alone could, for example, be taken for the transport before, through and after a heating device with a contacting heating roller that exerts pressure. Other subdivisions and combinations are also conceivable.

FIGS. 2 and 3 show a transport device 17 with lateral housing parts 55 extending over a transport section. As indicated in the enlarged section IIIa, the suction belt 19 is constructed as a mesh fabric with narrow through-passage openings 21. The suction belt 19 is driven by a drive shaft 57 and tensioned by a tension shaft 59. It runs continuously and seamlessly around these shafts 57, 59. The drive shaft 57 is driven via a motor 61. To guide it on the drive shaft 57, the suction belt 19 has raised guide ribs 63 running along its edge undersides which are in mesh in guide grooves of the drive shaft 57 (not shown in greater detail). The end of the transport device 17 in the transport direction 9 forms an outlet plate 65 for the delivery or transfer of the transported substrate 11.

The embodiment examples are not to be understood as a restriction of the invention. Moreover, numerous alterations and modifications are possible within the frame of the disclosure presented, in particular such variations, elements and combinations and/or materials, which, for example, by the combination or modification of individual characteristics and/or elements or process steps, described in connection with the general description and embodiment forms as well as claims, and contained in the drawings, can be ascertained by the expert in regard to the achieving the purpose and lead, through combinable characteristics, to a new object or to new process steps and/or process step sequences.

The invention has been described in detail with particular reference to certain preferred embodiments thereof, but it will be understood that variations and modifications can be effected within the spirit and scope of the invention.

| Parts List | |
|---|---|
| 1 | Copier or printer machine |
| 3 | Fixing device |
| 5 | 1st microwave resonator |
| 7 | 2nd microwave resonator |
| 9 | Transport direction |
| 11 | Substrate |
| 13 | Opening |
| 15 | Opening |
| 17 | Transport device |
| 19 | Suction belt |
| 21 | Through-passage openings |
| 23 | Guide roller |
| 25 | Guide roller |
| 27 | Guide roller |
| 29 | Guide roller |
| 31 | Magnetron |
| 33 | Suction box |
| 35 | Suction box |
| 37 | Arrow |
| 39 | Suction box |
| 41 | Vacuum chamber |
| 43 | Perforated plate |
| 45 | Connection channel |
| 47 | Connection channel |
| 49 | Fan |
| 51 | Upper side |
| 53 | Underside |
| 55 | Housing |
| 57 | Drive shaft |
| 59 | Tension shaft |
| 61 | Motor |
| 63 | Guide rib |
| 65 | Outlet plate |

What is claimed is:

1. Digital printer or copier machine for the single-sided or double-sided printing of a substrate using at least one toner, with at least one fixing device for fixing the toner onto the substrate, whereby the fixing device has at least one heating device for fusing the toner, and with at least one transport device, in order to supply the substrate to the heating device, to guide it past the heating device and/or to further transport it from the heating device, whereby the transport device has at least one suction belt that has a number of through-passage openings and that can be impinged with a vacuum, characterized in that the suction belt is constructed as a mesh having stays forming through-passage openings, the entire cross-section flow-through area of said through-passage openings being markedly greater than the entire area of said stays between said through-passage openings.

2. Printer or copier machine according to claim 1, characterized in that the through-passage openings each have a diameter that is less than 1.0 mm.

3. Printer or copier machine according to claim 1, characterized in that at least the surface of the suction belt coming into contact with the substrate is coated with a separating agent.

4. Printer or copier machine according to claim 3, characterized in that the suction belt is coated with a thin layer of a separating agent, in particular, with silicone oil.

5. Printer or copier machine according to claim 1, characterized in that at least the surface of the suction belt coming into contact with the substrate is coated with a material that has a low surface energy.

6. Printer or copier machine according to claim 1, characterized in that the adhesion of the substrate on the suction belt is done by electrostatic charging of the substrate and/or the suction belt and/or as a result of friction between the substrate and the suction belt.

7. Printer or copier machine according to claim 1, characterized in that the flat side of the suction belt coming into contact with the substrate has a defined surface roughness that is selected depending on a desired gloss of the fixed toner.

8. Printer or copier machine according to claim 1, characterized in that the heating device has at least one microwave resonator through which the suction belt is guided.

9. Printer or copier machine according to claim 1, characterized in that the suction belt is essentially made out of a fabric.

10. Printer or copier machine according to claim 9, characterized in that the suction belt has at least one anti-static element.

11. Printer or copier machine according to claim 10, characterized in that the anti-static element is integrated as yarn into the fabric.

12. Printer or copier machine according to claim 9, characterized in that the suction belt has at least one stiffening element.

13. Printer or copier machine according to claim 12, characterized in that the stiffening element is a fusing thread.

14. Printer or copier machine according to claim 1, characterized in that the suction belt is manufactured so that it is an endless closed loop.

15. Printer or copier machine according to claim 1, characterized in that the suction belt is essentially made out of polyester.

16. Printer or copier machine according to claim 1, characterized in that the suction belt has at least one guide element running in the rotation direction.

17. Printer or copier machine according to claim 16, characterized in that as guide elements, raised guide ribs are provided running along the edge undersides of the suction belt.

18. Printer or copier machine according to claim 17, characterized in that the guide ribs can be brought into mesh with guide grooves in a drive shaft for the suction belt.

* * * * *